United States Patent [19]

Borstel

[11] Patent Number: 4,467,145

[45] Date of Patent: Aug. 21, 1984

[54] HEARING AID

[75] Inventor: Heinz-Dieter Borstel, Erlangen, Fed. Rep. of Germany

[73] Assignee: Siemens Aktiengesellschaft, Berlin & Munich, Fed. Rep. of Germany

[21] Appl. No.: 347,929

[22] Filed: Feb. 11, 1982

[30] Foreign Application Priority Data

Mar. 10, 1981 [DE] Fed. Rep. of Germany ..... 3109049

[51] Int. Cl.[3] ..... H01R 25/00

[52] U.S. Cl. ..... 179/107 R; 381/123; 179/107 H; 179/82; 179/87

[58] Field of Search ..... 179/107 H, 107 FD, 107 R, 179/87, 82; 381/123

[56] References Cited

U.S. PATENT DOCUMENTS 3,396,245 8/1968 Flygstad ..... 179/107 R 4,071,714 1/1978 Satoh ..... 179/82

*Primary Examiner*—G. Z. Rubinson

*Assistant Examiner*—Robert Lev

*Attorney, Agent, or Firm*—Hill, Van Santen, Steadman & Simpson

[57] ABSTRACT

In an exemplary embodiment, switches are provided for controlling operating state, and the like, of a miniature hearing aid. In such hearing aids, it is a precondition that all components, thus the switches as well, be designed very small and function reliably. Therefore, the disclosure provides magnetic switches which exhibit elements whose electrical conductivity can be influenced with magnetic fields. For example, reed contacts or magnetic field responsive semiconductors are employed as such elements. Thus, manual switching can ensue by means of displacing a magnet. Magnetically actuatable switches, however, can also serve to automatically switch on an auxiliary element, for instance a device for improving the reception of a telephone call (induction coil), when a magnetic field present outside of the device, for instance the magnetic field of a telephone receiver, approaches. A hearing aid equipped according to the disclosure is particularly suited for use in conjunction with induction coils.

4 Claims, 4 Drawing Figures

HEARING AID

BACKGROUND OF THE INVENTION

The invention relates to a hearing aid according to the preamble of patent claim 1.

It has proven expedient in hearing aids to have simple switches which are easy to actuate and which are insensitive to external impairment. This is based primarily on the fact that persons who have little technical dexterity must also be involved with these devices and that mechanical influences (blows, imprecise actuation, etc.) and chemical influence (penetration of perspiration, etc.) are to be expected given such devices. Moreover, because of the limited mounting space which is available, it is required that the components for hearing aids, switches as well, be small, so that sturdy execution and shielding are usually not possible.

SUMMARY OF THE INVENTION

The object of the invention is to provide switches in hearing aids according to the preamble of claim 1 which, given small space requirements, exhibit great tolerances regarding the actuation and other influences. This object is inventively achieved by means of the features cited in the characterizing part of said claim 1.

As a result of employing elements which change their electrical properties, for instance their conductivity, under the influence of a magnetic field in the manner of a switch, the only thing which is still required for the actuation of the switching operation is the application of a magnetic field. A displaceable magnet can, for instance, be employed as the switch element. This means that precision is no longer demanded in the switch actuation. The magnetic field need only be brought into the proximity of the contact means in order to achieve the desired switch effect.

The actual electric circuit completing elements fall in the category of isolated-contact or contact-free switches and can, for example, be designed as so-called dry-reed contacts which are also known under the designation reed contacts or, respectively, can be designed as magnetic field responsive semiconductors, for example Hall generators. Such switch elements are listed, for example, in the "Elektronik Lexikon" by Dr. Walter Baier, Franckh'sche Verlagshandlung Stuttgart, 1974, under the corresponding entries.

The essence of reed contacts is the employment of ferromagnetic contact means which are caused to change their position under the influence of a magnetic field. Thus, it is possible to bring them from an open into a closed contact position (simple switch) or, respectively, to bring them from one contact position into another (changeover switch). Employable as magnetic field semiconductors are, for instance, semiconductor resistors consisting of indium antimonide (InSb)/nickel antimonide (NiSb) which change their resistance in the magnetic field.

Reed contacts and magnetic field responsive semiconductors have the advantage that they can be enclosed in a stable and tight encapsulation which is free of mechanical passages. Thus, they are lent a mechanically robust structure given which, moreover, chemical influences are also excluded.

Upon employment of a switch configuration according to the teachings of the present invention together with transmission means in which a magnetic field occurs, for example with the receiver of a telephone handset, according to a further advantage, the magnetic field occurring in the environment of the receiver can be employed to switch on an induction input stage of the hearing aid which is tuned to the receiver. To that end, it is expedient to incorporate the switch at a suitable location in the housing of the device so that given, for instance, the employment of a telephone or of head sets, the position of the magnetic field and, thus, its influence on the switch is promoted. Given hearing aids to be worn behind the ear, a position for reed contacts which is favorable in this sense lies aproximately in the center of the device in such manner that the reeds or contact spring fingers extend in a vertical direction when the device is worn. Thus, they come into the proximity of the ear channel in which the magnetic field preferably becomes effective when telephoning. A magnetic semiconductor switch element need only be brought to the corresponding location without special adjustment being necessary. This is based on the fact that the sensitivity is uniformly distributed in this element.

Further details and advantages are explained below on the basis of the exemplary embodiments illustrated in the Figures on the accompanying drawing sheet; and other objects, features and advantages will be apparent from this detailed disclosure and from the appended claims.

BRIEF DESCRIPTION OF THE DRAWINGS

A switch with two reed contacts is schematically illustrated in FIG. 1.

A wiring diagram for a hearing aid in which the two reed contacts according to FIG. 1 are incorporated is shown in FIG. 2.

DETAILED DESCRIPTION

Figure 1:
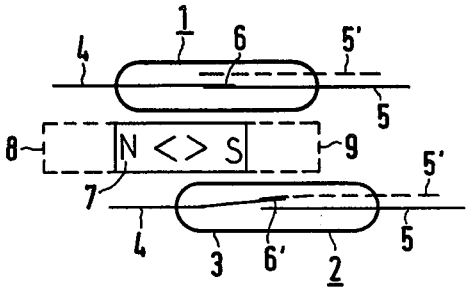
Figure 2:
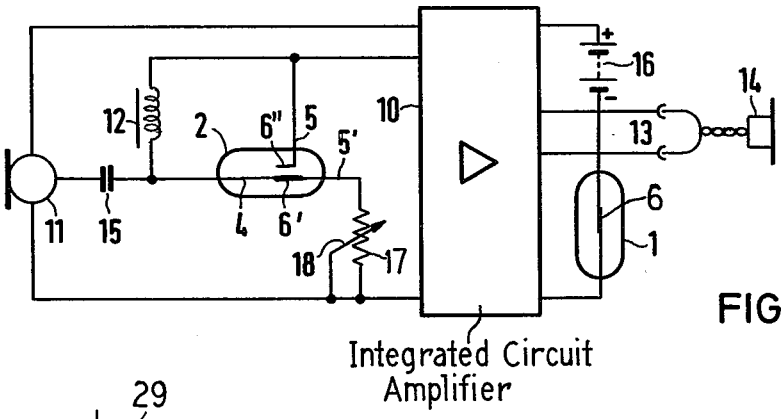

In FIG. 1, 1 and 2 indicate switches which, in the present case, are designed as reed contacts. The switches 1, 2 respectively are each comprised of a housing 3 consisting of glass in which contact springs 4 and 5, so-called switching tongues, are sealed gas-tight in a protective atmosphere. One or both switches 1, 2 can also be designed as changeover switches by means of a further contact 5' indicated with broken lines.

The contacts consist of ferromagnetic material and are introduced from opposite ends of housing 3 to such a depth that they overlap laterally and can contact one another at their ends in precisely such manner that, as in the case of switch 1, an electrical connection can be obtained which is referenced with 6. For that purposes, the only thing which is necessary is to introduce a magnet 7 into the position indicated with a solid line in FIG. 1.

When a displacement of the magnet 7 occurs in the direction of the one arrow to the location 8 bordered with broken lines, then the contact 6 is released. When, on the other hand, a displacement occurs toward the location 9, then the switch 2 which is still shown open in the Figure is also closed. Given a hearing aid, these switching operations can, for example, effect the switching-on of the device (switch 1) and the connection of an induction coil (switch 2).

A device in which the above design is realized consists, according to FIG. 2, of an amplifier 10 to which a microphone 11 and a hearing coil 12 are allocated as electro-acoustical input transducers. Moreover, via a plug-type contact 13, a receiver earpiece 14 is also allocated to the amplifier 10 as an electro-acoustical output transducer. The microphone 11 is connected to the amplifier 10 via a coupling capacitor 15. The device can be placed in operation with a 1.5 volt battery 16 when its connection to the hearing aid circuit is produced via the switch 1, i.e., by means of closing the electrical connection as shown at 6 in FIGS. 1 and 2.

In the connection of the microphone 11 to the amplifier 10, the switch 2 having an additional contact finger associated with conductor 5' is provided as a change-over switch. With circuit completion as indicated at 6' in FIGS. 1 and 2 for the switch 2, (electrically connecting conductive paths 4 and 5' of switch 2) the hearing coil 12 becomes effective as a pickup element in addition to the microphone 11. When the circuit is completed at 6" in FIG. 2 (electrically connecting conductive paths 4 and 5 of switch 2) the microphone 11 is connected given simultaneous short-circuiting of the coil 12.

Given simultaneous connection of the microphone 11 and of the coil 12 as pickup elements (corresponding to the condition of switch 2 shown in FIG. 2 and corresponding to the central position of magnet 7 shown in solid lines in FIG. 1), the regulator 17 also becomes effective. With the tap 18 of regulator 17 the amplitude of the signal coming from the mircophone 11 can be changed because, given the change of the resistance of the regulator 17 which lies between the tap 18 and the microphone 11, the microphone can be loaded up to a complete short circuit (the position of tap 18 which completely short circuits component 17). Thus, the microphone 11 can be continuously connected to the amplifier 10 and, vice versa, can also be continuously blanked out.

Figure 3:
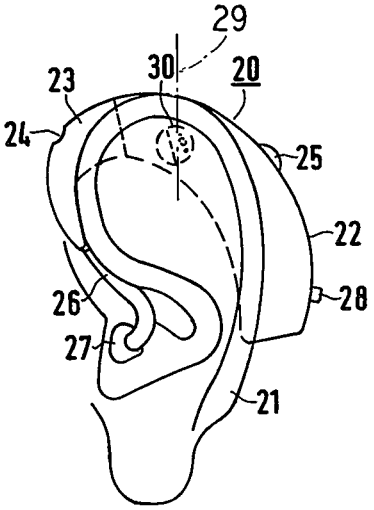
FIG. 3 shows a hearing aid to be worn behind the ear with a switch arrangement according to FIG. 1 in which the position of an automatic switch for switching on a hearing coil is indicated.

FIG. 3 shows the execution of the hearing aid as a behind-the-ear device 20 which is worn behind the ear 21. Thereby, the actual device 22 is secured to the upper end of the ear 21 by means of a carrying crook 23. The second is picked up via an opening 24 and proceeds to the microphone (11', FIG. 4) and is amplified in a known manner via an amplifier whose volume can be regulated by means of a regulator 25 and then proceeds via an earpiece receiver whose output connects into a sound conducting tube 26 which couples with the ear channel of the hearing aid wearer via a so-called ear olive 27. A manual actuator 28 can be seen on the device which controls an on-off switch (such as 1, FIGS. 1 and 2), the magnet referenced with 7 in FIG. 1 being displaceable in response to manual shifting of actuator 28 so that the device can be turned on and of (by means of the switch 1) and the hearing coil can also be switched on and off (by means of the switch 2). In addition, an automatic magnetic field responsive switch 30 is also indicated at the device 20, said magnetic switch 30 being able to automatically effect the switching-on of a hearing coil (12', FIG. 4) when a telephone receiver or head-set approaches.

Figure 4:
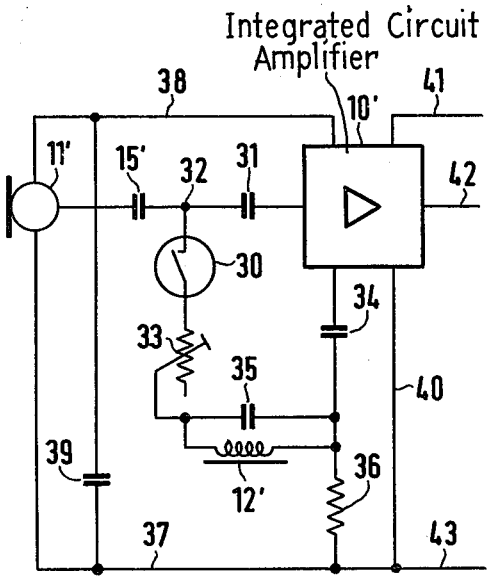
FIG. 4 shows a circuit arrangement including the automatic switch of FIG. 3.

An input part of a hearing aid amplifier 10' which contains an automatic switch 30 is schematically illustrated in FIG. 4. Thereby, the microphone 11' is connected via two coupling capacitors 15' and 31 to an integrated circuit serving as an amplifier 10'. In addition, an induction coil 12' is provided as a further input transducer. This can be switched on by means of the magnetic field responsive semiconductor switch 30. To that end, one terminal of the switch 30 is connected to the connection point 32 between the microphone 11' and the amplifier 10', the point 32 being intermediate the two capacitors 15' and 31. The other terminal of switch 30 is connected via a variable resistor 33, the induction coil 12' and a capacitor 34, to the amplifier 10', the induction coil 12' being bridged with a capacitor 35. In a manner standard in hearing aids, the capacitor 34, moreover, exhibits a connection via a resistor 36 to a line 37 which is connected to the microphone 11' and, via said microphone 11' a line 38, to a direct voltage output of the integrated circuit serving as the amplifier 10'. Thereby, the supply voltage for the microphone 11' is smoothed with a capacitor 39. The amplifier 10' also exhibits another line 40 proceeding to the line 37. The earpiece receiver is connected, for example, between the terminals 41 and 42 of the integrated circuit employed as the amplifier 10'. The direct voltage supply ensues via the terminals 41 and 43. The alternating voltage output is referenced with 42.

It will be apparent that many modifications and variations may be effected without departing from the scope of the novel concepts and teachings of the present invention.

Supplementary Discussion

In FIG. 1, the opposite ends of permanent magnet 7 have been marked with the symbols "N" and "S" to indicate that these longitudinal ends may form the north and south magnetic poles of the magnet.

In FIG. 3, magnetic switch element 30 may alternatively represent the location of a magnetic reed switch such as indicated 1 in FIG. 1. The magnetic reed type switching fingers are preferably oriented substantially along a vertical axis indicated at 29 of behing-the-ear device 20. Thus, each finger would be oriented in a substantially vertical direction when the ear of the user conformed with a normal upright orientation. For the case of a telephone handset, for example, when coupled with the hearing coil 12', FIG. 4, the field produced by the handset receiver during reception of acoustic signals, will serve to actuate the reed type switching fingers to the switching condition wherein the hearing coil 12' is electrically connected to the input of amplifier 10', FIG. 4. The response time of the switch element 30, whether of the reed contact type or the magnetic field sensitive semiconductor type will be sufficiently rapid so that the hearing coil 12' will be effective to transmit essentually all of the incoming part of a telephone conversation or the like to the input of amplifier 10' for amplification.

In FIG. 1, the contact finger of switch 1 associated with the conductive path 4 is of ferromagnetic material and is resiliently biased toward the nonmagnetic contact finger associated with conductive path 5'. Similarly, the finger of switch 2 associated with conductive path 4 is of ferromagnetic material and is resiliently biased toward the nonmagnetic contact finger associated with the conductive path 5'.

Where the circuit of FIG. 2 is associated with the device 20 of FIG. 3, a magnetic reed switch at location 30 in FIG. 3 would have its contacts reversed so that the magnetic contact finger associated with conductive path 4 would be resiliently biased toward a nonmagnetic contact finger associated with conductive path 5 so as to shortcircuit induction coil 12 in the absence of an actuating magnetic field from the handset of a telephone receiver or the like.

For the sake of background, the entries concerning reed contacts and Hall effect and Hall generators in the technical dictionary "Elektronik Lexikon" of 1974 are set forth on the following pages.

*Elektronik Lexikon,* p. 474, right column, last paragraph to p. 275, left column, paragraph one Reed contact.

Component of modern message switching technology. Contacts for the connection of conducting wires in telephone and teletype systems, for the purpose of protection from dust, humidity and corroding gases, are housed in air-tight sealed small tubes in a protective gas atmosphere and are then called protective tube contacts or reed contacts (see relay, reed-). The contact springs consist of ferromagnetic material and can therefore be moved like electromagnets if they are surrounded by a corresponding magnetic field. This field is generated in a relay coil which surrounds the contact. The combination coil/reed contact has also become known under the designation of Herkon relay and is being employed in modern systems. Message switching systems in which only electronic components and reed contacts (Herkon relays) are employed are called quasi-electronic (see also telephone relays). [24]

Literature: K. Bergmann, Lehrbuch der Fernmeldetechnik, 1970; Bartels/Oklobdzija, Schaltungen und Elemente der digitalen Technik, 1964; H. Woller v. K. Sobotta, Neuzeitliche Fernsprechvermittlungstechnik, Stuttgart 1968 [24].

*Elektronik Lexikon,* p. 230, right column

Hall Effect.

Occurrence of a voltage $U_H$ (Hall [! text illegible] voltage) over the width b of a plate which is perpendicularly permeated by a homogeneous magnetic field (induction $\beta$) and is flown through, perpendicularly thereto, by a current of the current density j.

$$U_H = R \cdot \beta \cdot b \cdot j$$

R = Hall constant.

The Hall voltage is hardly measureable in the case of metals; however, in the case of semiconductive materials; for example, indium arsenide or indium antimonide, it can attain values up to 1 V. It results due to the strong deflection of the charge carriers in the magnetic field. In the graphic representation, with regard to the flat conductor, a displacement of the lines of equal potential results. [8, 26].

The analytic examination of the conductivity is not simple. It has been shown that the measurement of the Hall voltage provides information about the carriers and mechanism of conductivity. The influence of a magnetic field on the charge carrier movement is here examined. Through the Lorentz force a deflection of the carriers toward one direction will take place independently of whether it is a question of positive or negative particles. A space charge zone develops which generates an electric counterfield. This counterfield (Hall field) compensates the center deflection of the charge carriers by the Lorentz force. From the directional sense of the rotation of the field intensity inference regarding the sign of the charge carriers is possible. The Hall voltage is measured perpendicularly to the applied voltage. From the determination of the conductivity (product of carrier density and mobility), through measurement of the Hall voltage, also the carrier density alone can be ascertained. [19]

Literature: O. Madelung, Grundlagen der Halbleiterphysik, Berlin, Heidelberg, New York 1970; E. Spenke, Elektronische Halbleiter, 2. Auf., Berlin, Göttingen, Heidelberg 1965 [19].

Hall Generator.

Component for the technical application of the Hall effect. On account of the possible smallness of these components they can be employed e.g. for the measurement of the determining magnitudes of magnetic fields at inaccessible locations. The current is here kept constant by the H.—the control current—thus the emitted Hall voltage is a direct measure of the magnetic field intensity. The fact that the Hall voltage is proportional to the product of control current and the magnetic field intensity can be utilized for the purpose of multiplication; for example, in the measurement of electric power. This is particularly advantageous in the case of rapidly variable operations. On account of the thin layers from which Hall generators are constructed, their cut-off frequency is very high. Hall generators are also suitable for the sampling of audio tapes. In the most recent times, they are available in the form of a part of integrated circuits; Hall generators and amplifiers are joined on a silicon disk. Main application: contactless switches. [8. 26]

I claim as my invention:

1. A hearing aid system having a hearing aid electric circuit including switch means, characterized in that an element changing its electrical properties in the manner of a switch due to the influence of a magnetic field is employed in the switch means of the electrical circuit; and in that magnetic field producing means functions as the actuator for the switch means, with said magnetic field producing means comprising a permanent magnet, and means mounting said permanent magnet for manual actuation between a first position with said element out of the effective field range of said permanent magnet, and a second position with the magnetic field of said permanent magnet actuating said element so as to change its electrical properties and produce a different switching state.

2. A hearing aid system according to claim 1, characterized in that the element is a reed contact.

3. A hearing aid system according to claim 1, characterized in that the element is a magnetic field responsive semiconductor.

4. A hearing aid system according to claim 1, with said switch means comprising a first switch for turning said circuit on and off and a second switch for altering the operation of said circuit, said switches each comprising an element as aforesaid responsive to a magnetic field to change its switching state, and means mounting said permanent magnet for manual actuation between a first position with both of the elements out of the effective field range of said permanent magnet, and a second position with the magnetic field of said permanent magnet actuating both of the elements so as to change the switching state of said first and second switches.

* * * * *